United States Patent [19]

Ebi

[11] Patent Number: 4,570,147

[45] Date of Patent: Feb. 11, 1986

[54] TIME DELAY FUSE

[75] Inventor: Masashi Ebi, Gifu, Japan

[73] Assignee: Pacific Engineering Company, Ltd., Ohgaki, Japan

[21] Appl. No.: 659,035

[22] Filed: Oct. 10, 1984

Related U.S. Application Data

[63] Continuation of Ser. No. 254,658, Apr. 16, 1980, abandoned.

[30] Foreign Application Priority Data

Apr. 28, 1980 [JP] Japan ..... 55-58756
Apr. 28, 1980 [JP] Japan ..... 55-58757

[51] Int. Cl.[4] ..... H01H 85/10
[52] U.S. Cl. ..... 337/166; 337/295
[58] Field of Search ..... 337/166, 195, 197, 198, 337/276, 278, 280, 295, 163

[56] References Cited

U.S. PATENT DOCUMENTS

| | | | |
|---|---|---|---|
| 2,004,191 | 6/1935 | Bussmann | 337/166 |
| 2,326,257 | 8/1943 | Schmidt et al. . | |
| 2,557,587 | 6/1951 | Baenziger | 337/166 |
| 2,683,788 | 7/1954 | Von Hoorn | 337/166 |
| 2,688,061 | 8/1954 | Kozaka | 337/166 |
| 2,773,961 | 12/1956 | Sundt | 337/166 |
| 3,333,076 | 7/1967 | Jacks et al. . | |
| 3,524,157 | 8/1970 | Salzer | 337/295 |

FOREIGN PATENT DOCUMENTS

| | | |
|---|---|---|
| 138719 | 4/1902 | Fed. Rep. of Germany . |
| 2714797 | 2/1979 | Fed. Rep. of Germany . |
| 727057 | 6/1932 | France . |
| 1043620 | 11/1953 | France . |

*Primary Examiner*—William H. Beha, Jr.
*Attorney, Agent, or Firm*—Wegner & Bretschneider

[57] ABSTRACT

A fuse comprising a casing, a fusible element disposed within the casing and a member made of ceramics mounted to the fusible element, the fusible portion of the fusible element being situated within a recess formed in the member.

15 Claims, 7 Drawing Figures

TIME DELAY FUSE

This application is a continuation application of U.S. application Ser. No. 254,658, filed Apr. 16, 1980, now abandoned.

This invention relates to a fuse extensibly used in electrical circuits for vehicles such as automobiles.

Electrical fuses are generally required to have so-called quick-blow characteristics, that is, the characteristic to interrupt circuits rapidly against excess current. In electrical circuits for automobiles, for example, a circuit for supplying electrical power to an electrical motor for starting an engine or a circuit for supplying electrical power to an electrical motor for opening and closing car windows or door windows, great current several times as high as usual current flows upon starting of the power supply or complete opening or closure of the windows. It is therefore necessary in these circuits to use such fuses as having great current ratings that will neither fuse nor cause wear destruction even under the great current several times as high as the usual current.

However, the use of such fuses of great current ratings in the circuits makes it difficult, on the contrary, to interrupt the current in a case of short circuit where a current below the rated current value but greater than the usual current value flows through the circuit, that is, in the case of rare short circuit, which causes power loss, burning of coverings on electrical wires and fusion of the wires per se in the circuit. Although the burning of the wire coverings and the fusion of the wires can be prevented to some extent by increasing the diameter of the wires, this may undesirably increase the weight and the cost of the wires.

An object of this invention is to provide a fuse capable of reducing excess sensitivity to fusion and wearing destruction when applied to circuits in which great current several times as high as the usual current flows in a short time.

Another object of this invention is to provide a fuse capable of surely interrupting the circuit upon rare short circuit and complete short circuit.

A further object of this invention is to provide a fuse capable of rapidly disconnecting the circuit upon complete short circuit.

A further object of this invention is to provide a highly reliable fuse capable of surely fusing with no effects from ambient temperature and having stable characteristics.

A further object of this invention is to provide a fuse which is small in the size, reduced in the weight and inexpensive.

A further object of this invention is to provide a fuse capable of reducing the thermal effects to other equipments upon fusion.

A further object of this invention is to provide a fuse having a sufficient working life even used in circuits in which great current several times as high as usual current flows frequently.

A further object of this invention is to provide a fuse whose fusing characteristics can be changed with ease, so as to provide fusing characteristic suitable to various circuits with ease.

This invention provides a fuse device comprising a plate-like fusible element having a fusible portion at intermediate portion thereof, terminals provided on both ends of the fusible element, and a heat conduction member made of inorganic material and being in contact with a fusible element, the fusible portion of the fusible element being kept apart from the heat conduction member at least in the fusing state.

This invention is to be described by way of preferred embodiments referring to the accompanying drawings, by which the foregoing object and features, as well as other objects and features of this invention will be made more clear in which FIG. 1 is a cross sectional view for one embodiment of this invention;

Figure 1:
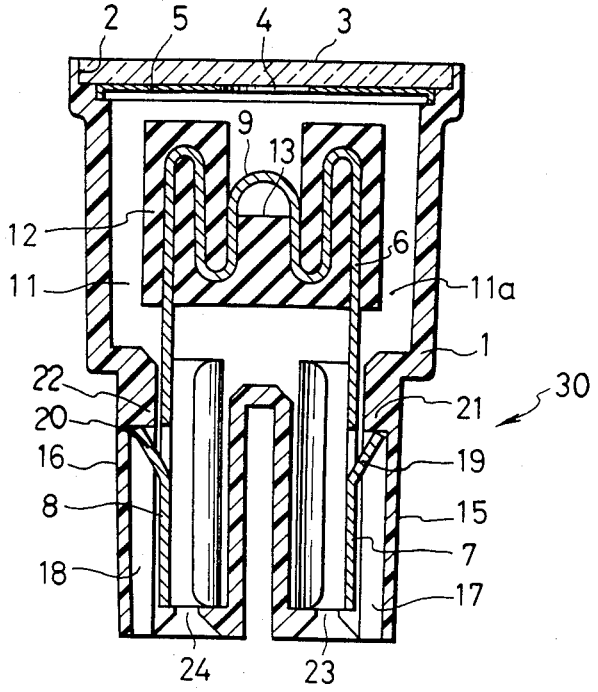
Figure 2:
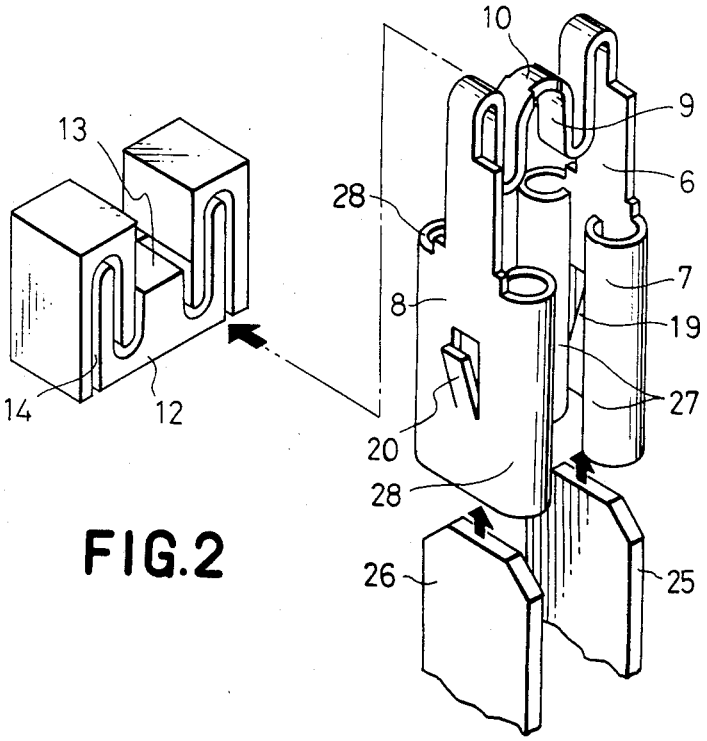
FIG. 2 is a perspective view for the fusable element and the heat conduction member shown in FIG. 1.

In FIG. 1 and FIG. 2, a casing 1 made of electrically insulating material has an opening 2, to which a transparent synthetic resin plate 3 is secured. A metal plate 5 having a window 4 is disposed between the plate 3 and the casing 1. The plate 3 and 5 close the opening 2 of the casing 1. The casing 1 is, preferably, formed from heat resistant synthetic resin. Within the casing 1, are mounted a plate-like fusible element 6 which is bent smoothly in multi-turns, and terminals 7 and 8 integrally extending from both ends of the fusible element 6 respectively. The fusible element 6 has at its intermediate position a fusible portion 9 which is provided as desired, with a weak spot 10 having reduced width. The fusible element 6, the terminals 7 and 8 are made of copper alloy, for example, with melting temperature above 800° C. and integrally formed by way of pressing or the like. The fusible element 6, the terminals 7 and 8 may not necessarily be formed integrally but the element 6, the terminals 7 and 8 can be formed separately and then connected to each other electrically by way of press-fitting or the like. A heat conduction member 12 secured to the fusible element 6 is provided in an inside space or chamber 11 defined within the casing 1, and the member 12 has a recess 13. The heat conduction member 12 is diposed in the space 11 with a predetermined gap 11*a* each from the casing 1 and the metal plate 5, and the air gap 11*a* around the heat conduction member 12 functions as a heat insulating space for the heat transfer from the heat conduction member 12 to the casing 1. The heat conduction member 12 is, preferably, made of inorganic material excellent in heat resistance and heat conductivity and having a great heat capacity, for example, metal, glass or ceramic material. In a case where the member 12 is made of material having electric conductivity such as metal material, the member 12 and the element 6 are electrically insulated from each other by means of, for example, an insulating layer provided around the element 6. The fusible element 6 is embedded within the heat conduction member 12 except for the fusible portion 9 which can be observed for its fusion from the outside by way of the transparent plate 3 and the window 4, whereby the fusible element 6 is contacted with the heat conduction member 12. The fusible element 6 is embedded into the heat conduction member 12 by at first forming a groove 14 to the heat conduction member 12 in such a shape as corresponding to the corrugated configuration of the fusible element 6, then inserting the fusible element 6 into the groove 14 and, thereafter, applying inorganic adhesives, for example, ceramic adhesives so as to fill the groove 14 thereby bonding the fusible element 6 and the heat conduction member 12. The terminals 7 and 8 are inserted respectively into the spaces 17 and 18 formed in the leg portions 15 and 16 of the casing 1, so that the terminals 7 and 8 are supported by the casing 1. The terminals 7 and 8 are prevented from slipping off the leg portions 15 and 16 by the abutment of the lips 19 and 20 formed to the terminal 7 and 8 on the projections 21 and 22 of the casing 1 respectively. Rectangular openings 23 and 24 are provided to one end of the legs 15 and 16 for communicating the spaces 17 and 19 with the outside. Connecting terminals 25, 26 provided on an electrical circuit are inserted through the openings 23 and 24 from the outside into the spaces 17 and 18. The terminals 7, 8 have engagements 27 and 28 which are bent cylindrically so as to surely hold and make an electrical connection with the inserted terminals 25 and 26.

Figure 3:
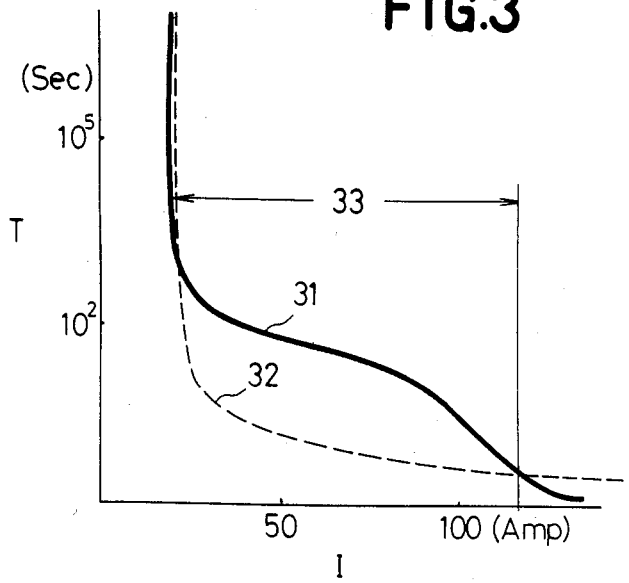
FIG. 3 is a fusing characteristic curves of the fuse of the embodiment shown in FIG. 1 and the conventional fuse.

When electrical current flows through the fusible element 6 to heat it in the fuse 30, the heat in the fusible element 6 is transferred to the heat conduction member 12, and, accordingly, the fusible element 6 is not heated so much by the current that flows for a short time. That is, since the heat generated in the fusible element 6 by a current greater than the rated value which flows for a short time to the fusible element 6 in a time interval longer than the predetermined interval successively transferred to and heat the heat conduction member 12 and, at the same time, discharged from the member 12 to air gap 11*a*, the fusible element 6 is not heated to such a high temperature as the fusible portion 9 or spot 10 is fused. While on the other hand, in a case of complete short circuit, for example, where an excessively great current flows through the circuit, the temperature of the fusible element 6 rapidly rises with all the heat transfer from the fusible element 6 to the heat conduction member 12, whereby the temperature in the fusible portion 9 or spot 10 arrives at the melting temperature to blow the fusible element 6. On the contrary, in a case of rare short circuit, for example, where a current not excessively great but greater than the rated current, for example, a current three times as high as the usual current flows continuously in the fuse 30 through the fusible element 6, the heat conduction member 12 is gradually heated as the fusible element 6 is heated. If the amount of the heat discharged from the heat conduction member 12 is lower than that for heating the fusible element 6 by the continuous current, the temperature in the fusible element 6 and the conduction member 12 gradually rises, whereby the temperature of the fusible portion 9 finally arrives at the melting temperature to fuse the fusible portion 9 or spot 10. Considering the foregoings, the current-fusion time I(Amp)-T(sec) characteristics of the fuse 30 are represented by the curve 31 shown in FIG. 3. The I-T characteristic for the conventional fuses is generally represented by the curve 32. It is apparent from the comparison between the curve 31 and the curve 32 that the fuse 30 is not fused in the region 33 which is the current region exceeding the rated value unless the current flows through the fusible element continuously in a time longer than that for the conventional fuses. In other words, the fuse 30 has the slow-blowing characteristic in the region 33 in comparison with the conventional fuses.

Figure 4:
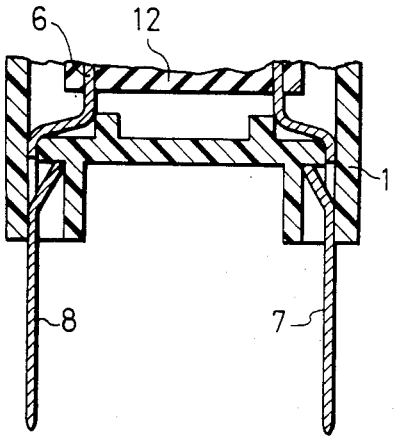
FIG. 4 is a cross sectional view for a part of another embodiment of this invention.

Although the terminals 7 and 8 are formed in the foregoing embodiment as the receptacles for the terminals 25 and 26, the terminals 7 and 8 may be projected out of the casing 1 and inserted into the receptacles provided on the circuit as shown in FIG. 4.

Figure 5:
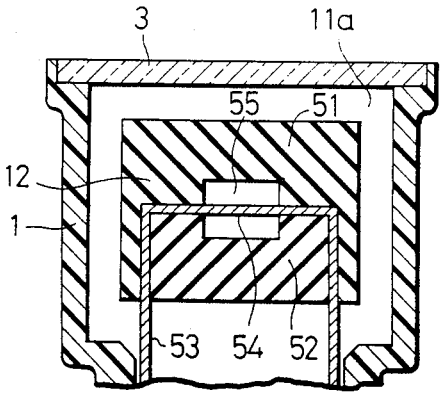
FIG. 5 is a cross sectional view for a part of another embodiment in which the heat conduction member is bisected.

In another embodiment, the heat conduction member may be formed from two members 51 and 52 as shown in FIG. 5, in which one member 51 is bonded to one broad width surface of a fusible element 53 which is similar to the fusible element 6 by means of inorganic adhesives, for example, ceramic adhesives and, while on the other hand, the other member 52 is bonded to the opposite broad width surface of the fusible element 53 by means of the same adhesives as above. In addition, the fusible portion 54 of the fusible element 53 may be disposed within and transversing a chamber or a space 55 defined by the members 51, 52. As shown in FIG. 5, although the fusible element is not necessarily be corrugated, it is preferred to corrugated the element as shown in FIG. 1 so that stresses caused in the heat expansion or contraction do not localize on the fusible element.

Furthermore, arc-quenching filler may be filled in the recess 13 or the space 55 while surrounding the fusible portion 9 or 54 so as to prevent the generation of arcs and thereby prevent destruction and burning of the casing 1 caused by high temperature upon fusion of the fusible portion 9 or spot 10, a portion 54 by great current.

Figure 6:
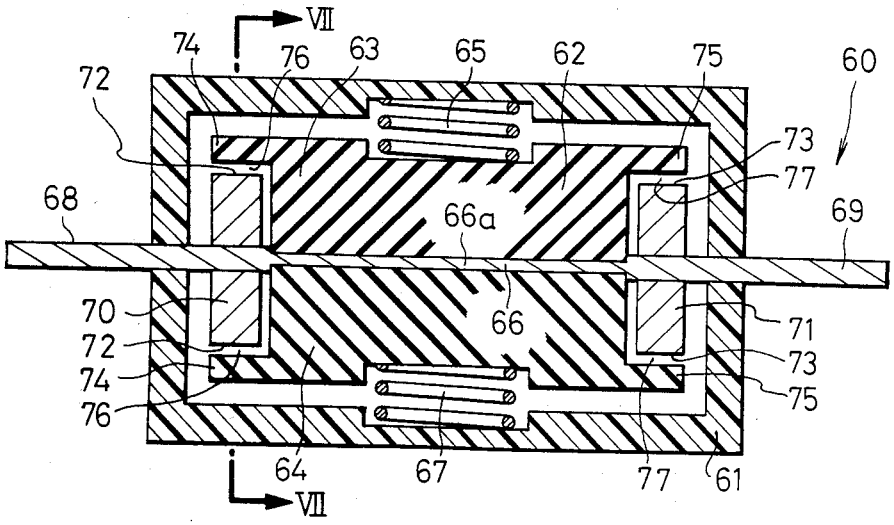
FIG. 6 is a cross sectional view for another embodiment of this invention.
Figure 7:
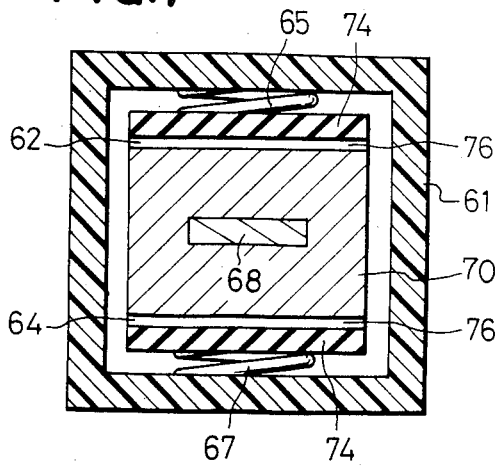
FIG. 7 is a cross sectional view taken along line VII—VII shown in FIG. 6.

Although the fusible portion 9 or 54 is disposed in the recess 13 or the space 55, so that the portion may be kept apart from the heat conduction member 12 both in the fusion and other states in the foregoing embodiments, the fuse may alternatively be formed, for example, as a fuse 60 as shown in FIG. 6. In the fuse 60, a heat conduction member 62 made of inorganic material such as metal, ceramic or glass is disposed with a heat insulating space therearound within a casing 61. The heat conduction member 62 comprises two members 63 and 64, in which the member 63 is pressed against one broad width surface of a plate-like fusible element 66 by a spring 65 located between the member 63 and the casing 61 and, while on the other hand, the member 64 is pressed against the other broad width surface of the fusible element 64 by a spring 67 located between the member 64 and the casing 61. In a case where the member 63 and 64 are made of material having electric conductivity such as metal, the member 63, 64 and the element 66 are electrically insulated from each other. Terminals 68 and 69 integrally provided on both ends of the fusible element 66 respectively are extended externally passing through the casing 61, and the terminals 68 and 69 are secured with heat expansible members, for example, members 70 and 71 made of praffin wax or the like respectively.

Both end faces 72 and 73 of the members 70 and 71 are opposed to the projections 74 and 75 extended integrally from the members 63 and 64 respectively, and air gaps 76 and 77 are disposed between the projections 74 and 75, and the members 70 and 71 respectively.

In a case where a current below a rated value flows continuously to the fusible element 66 by way of the terminals 68 and 69, or in a case where a current greater than the rated value flows discretely only for a short time in the fuse 60, the heat generated in the fusible element 66 is transferred to the heat conduction members 63 and 64 in contact with the element 66 and discharged from the members 63 and 64. Consequently, the fusible element 66 is scarcely heated, members 70 and 71 are not expanded so much and the fusible portion 66*a* of the fusible element 66 in contact with the heat conduction members 63 and 64 is not fused. While on the other hand, in a case where a current greater than the rated value flows through the fusible element 66 for a long time, the fusible element 66 and the heated expansible members 70 and 71 are heated simultaneously, whereby the members 70 and 71 expand thermally to abut at the end faces 72 and 73 thereof against the projections 74 and 75. The heat expansible members 70 and 71, when expanded further, cause the heat conduction members 63 and 64 to move away from each other against the resilient force of the springs 65 and 67. When the members 63 and 64 are aparted from each other, contact between the members 63 and 64, and the fusible element 66 including the fusible portion 66*a* is lost to rapidly rise the temperature of the fusible element 66 thereby fuse the fusible portion 66*a* finally. In a case where an excessively great current flows through the fusible element 66, the temperature of the element 66 rapidly rises before the heat is transferred to and discharged from the heat conduction members 63 and 64 to thereby rapidly fuse the fusible portion 66*a*. Accordingly, the same characteristics as those of the fuse 30, that is, the characteristics shown by the curve 31 in FIG. 3 can be obtained also by the fuse 60.

What is claimed is:

1. A time delay fuse comprising a casing means housing a plate-like fusible element and a heat conduction member made of ceramics, said heat conduction member formed from one piece and having first, second, third, and fourth planes opposing the sides of said casing means respectively, fifth, sixth, and seventh planes opposing an upper plate of said casing means that is perpendicular to the sides of said casing means, eighth and ninth planes, between which is located said seventh plane, opposing said first and second planes respectively so as to form a recess together with said seventh plane, and a tenth plane opposing said fifth, sixth and seventh planes, said heat conduction member further having a groove in which said heat conduction member is in contact with said fusible element, said groove extending from said third plane toward said fourth plane with regard to depth and having width corresponding substantially to the thickness of said fusible element, said fusible element including a first convex arc portion directed toward said upper plate, said first convex arc portion having a fusible portion in the middle thereof, first side portions elongating toward said tenth plane from the ends of said first convex arc portion where one end of said first side portions is continuously connected to said first convex arc portion, second convex arc portions directed toward said tenth plane and formed outside said first side portions and extending from opposing ends of said first side portions, second side portions elongating toward said fifth and sixth planes from one end of said second convex arc portions where each end of said second side portions is continuously connected to said second convex arc portions, third convex arc portions directed toward said fifth and sixth planes and formed outside said second side portions and extending from each end of said second side portions, third side portions elongating toward said tenth plane from one end of said third convex arc portions where one end of said third side portions is continuously connected to third convex arc portions, and terminal portions provided on the other end of said third side portions, said first to third convex arc portions and said first to third side portions of said fusible element being arranged symmetric to a line connecting a top point of said first convex arc portion with a middle point of a straight line, which connects one end of said first convex arc portion with the other end of said first convex arc portion, said first and second side portions and second and third convex arc portions of said fusible element being secured to said heat conduction member in said groove by means of ceramic adhesive so as to provide contact of said heat conduction member with said fusible element, said first convex arc portion being disposed within said recess so that said heat conduction member is kept apart from said first convex arc portion, said heat conduction member being spaced and thermally isolated from said casing means, whereby in an overcurrent condition of short duration said heat conduction member will absorb the heat generated in said fusible element, but in a sustained overcurrent condition, the temperature of said heat conduction member will rise to an extent allowing said fusible element to fuse.

2. The time delay fuse of claim 1 wherein said terminal portions are supported by said casing means.

3. The time delay fuse of claim 2 wherein said heat conduction member is provided with a heat insulating space therearound.

4. The time delay fuse of claim 2 wherein said terminal portions are enclosed by said casing means.

5. The time delay fuse of claim 2 wherein said terminal portions project from the inside to the outside of said casing means.

6. A time delay fuse comprising a casing means housing a plate-like fusible element and a heat conduction member made of ceramics, said heat conduction member formed from one piece and having first, second, third, and fourth planes opposing the sides of said casing means respectively, fifth, sixth, and seventh planes opposing an upper plate of said casing means that is perpendicular to the sides of said casing means, eighth and ninth planes, between which there is said seventh plane, opposing said first and second planes respectively so as to form a space together with said seventh plane, and a tenth plane opposing said fifth, sixth, and seventh planes, said heat conduction member further having a groove in which said heat conduction member is in contact with said fusible element, said groove extending from said third plane toward said fourth plane with regard to depth and having width corresponding substantially to the thickness of said fusible element, said fusible element including a first convex arc portion directed toward said upper plate, said first convex arc portion having a fusible portion in the middle thereof, first side portions elongating toward said tenth plane from the ends of said first convex arc portion where one end of said first side portions is continuously connected to said first convex arc portion, second convex arc portions directed toward said tenth plane and formed outside said first side portions and extending from other ends of said first side portions, second side portions elongating toward said fifth and sixth planes from one end of said second convex arc portions where one end of said second side portions is continuously connected to said second convex arc portions, third convex arc portions directed toward said fifth and sixth planes and forward outside of said second side portions and extending from the other ends of said second side portions, third side portions elongating toward said tenth plane from one end of said third convex arc portions where one end of said third side portions is continuously connected to third convex arc portions, and terminal portions provided on the other ends of said third side portions, said first to third convex arc portions and said first to third side portions of said fusible element being arranged symmetric to a line connecting a top point of said first convex arc portion with a middle point of a straight line, which connects one end of said first convex arc portion with the other end of said first convex arc portion, said first and second side portions and second and third convex arc portions of said fusible element being secured to said heat conduction member in the groove by means of ceramic adhesive so as to provide contact of said heat conduction member with said fusible element, said first convex arc portion being disposed within said space so that said heat conduction member is kept apart from said first convex arc portion, said heat conduction member being spaced and thermally isolated from said casing means, whereby in an overcurrent condition of short duration said heat conduction member will absorb the heat generated in said fusible element, but in a sustained overcurrent condition, the temperature of said heat conduction member will rise to an extent allowing said fusible element to fuse.

7. The time delay fuse of claim 6 wherein said terminal portions are supported by said casing means.

8. The time delay fuse of claim 7 wherein said heat conduction member is provided with a heat insulating space therearound.

9. The time delay fuse of claim 7 wherein said terminal portions are enclosed within said casing means.

10. The time delay fuse of claim 7 wherein said terminal portions project from the inside to the outside of said casing means.

11. A time delay fuse comprising a casing means housing a plate-like fusible element and a heat conduction member made of ceramics, said heat conduction member formed from one piece and having first, second, third, and fourth planes opposing the sides of said casing means respectively, fifth, sixth, and seventh planes opposing an upper plate of said casing means that is perpendicular to the sides of said casing means, eighth and ninth planes, between which there is said seventh plane, opposing said first and second planes respectively so as to form a recess together with said seventh plane, and a tenth plane opposing said fifth, sixth, and seventh planes, said heat conduction member further having a groove in which said heat conduction member is in contact with said fusible element, said groove extending from said third plane toward said fourth plane with regard to depth and having width corresponding substantially to the thickness of said fusible element, said fusible element including a first convex arc portion directed toward said upper plate, said first convex arc portion having a fusible portion in the middle thereof, first side portions elongating toward said tenth plane from ends of said first convex arc portion where one end of said first side portions is continuously connected to said first convex arc portion, second convex arc portions directed toward said tenth plane and formed outside of said first side portions and extending from the other end of said first side portions, second side portions elongating toward said fifth and sixth planes from one end of said second convex arc portions where one end of said second side portions is continuously connected with said second convex arc portions, third convex arc portions directed toward said fifth and sixth planes and formed outside of said second side portions and extending from the other ends of said second side portions, third side portions elongating toward said tenth plane from one end of said third convex arc portions where one end of said third side portions is continuously connected with third convex arc portions, and terminal portions provided on the other end of said third side portions, said first to third convex arc portions and said first to third side portions of said fusible element being arranged symmetric to a line connecting a top point of said first convex arc portion with a middle point of a straight line, which connects one end of said first convex arc portion with the other end of said first convex arc portion, said first and second side portions and second and third convex arc portions of said fusible element being embedded in said heat conduction member in said groove by means of ceramic adhesive so as to provide contact of said heat conduction member with said fusible element, said first convex arc portion being disposed within said recess so that said heat conduction member is kept apart from said first convex arc portion, said heat conduction member being spaced and thermally isolated from said casing means, whereby in an overcurrent condition of short duration said heat conduction member will absorb the heat generated in said fusible element, but in a sustained overcurrent condition, the temperature of said heat conduction member will rise to an extent allowing said fusible element to fuse.

12. The time delay fuse of claim 11 wherein said terminal portions are supported by said casing means.

13. The time delay fuse of claim 12 wherein said heat conduction member is provided with a heat insulating space therearound.

14. The time delay fuse of claim 12 wherein said terminal portions are enclosed within said casing means.

15. The time delay fuse of claim 12 wherein said terminal portions project from the inside to the outside of said casing means.

* * * * *